US010677548B2

(12) United States Patent
Gibbens et al.

(10) Patent No.: US 10,677,548 B2
(45) Date of Patent: Jun. 9, 2020

(54) LOWER RECEIVER

(71) Applicants: Kevin W. Gibbens, Mesa, AZ (US); David W. Gibbens, Mesa, AZ (US)

(72) Inventors: Kevin W. Gibbens, Mesa, AZ (US); David W. Gibbens, Mesa, AZ (US)

(73) Assignee: Gibbens Engineering Group, LLC, Mesa, AZ (US)

( * ) Notice: Subject to any disclaimer, the term of this patent is extended or adjusted under 35 U.S.C. 154(b) by 16 days.

(21) Appl. No.: 15/997,499

(22) Filed: Jun. 4, 2018

(65) Prior Publication Data

US 2018/0347925 A1 Dec. 6, 2018

Related U.S. Application Data

(60) Provisional application No. 62/514,569, filed on Jun. 2, 2017.

(51) Int. Cl.

| | |
|---|---|
| ***F41A 3/66*** | (2006.01) |
| ***F41A 15/16*** | (2006.01) |
| ***F41A 9/59*** | (2006.01) |
| ***F41A 35/06*** | (2006.01) |

(52) U.S. Cl.

CPC ..... *F41A 3/66* (2013.01); *F41A 9/59* (2013.01); *F41A 15/16* (2013.01); *F41A 35/06* (2013.01)

(58) Field of Classification Search

CPC ..... F41A 15/14; F41A 15/16; F41A 3/66
USPC ..... 42/47
See application file for complete search history.

(56) References Cited

U.S. PATENT DOCUMENTS

| | | | | |
|---|---|---|---|---|
| 6,966,137 | B2 * | 11/2005 | Gussalli Beretta | F41A 15/14 42/16 |
| 10,415,913 | B2 * | 9/2019 | Wyssen | F41A 17/38 |
| 2017/0299303 | A1 * | 10/2017 | Phipps | F41A 3/66 |

FOREIGN PATENT DOCUMENTS

| | | | |
|---|---|---|---|
| GB | 691584 | * | 5/1953 |

* cited by examiner

*Primary Examiner* — Stephen Johnson
(74) *Attorney, Agent, or Firm* — Schmeiser, Olsen & Watts LLP

(57) ABSTRACT

A lower receiver that may be right hand or left hand configurable is provided. The lower receiver includes a static ejector that can be easily configured for right hand or left hand positions within the same lower receiver and a magazine button assembly having a left magazine button and a right magazine button that are operatively coupled together so that either magazine button can be pushed to release the magazine. This allows the gun builder to use this one lower receiver to build a right or left handed rifle.

8 Claims, 12 Drawing Sheets

LOWER RECEIVER

CROSS REFERENCE TO RELATED APPLICATION

This application claims priority to U.S. Provisional Patent Applications entitled "LOWER RECEIVER," Ser. No. 62/514,569, filed Jun. 2, 2017, the disclosure of which is hereby incorporated entirely herein by reference.

BACKGROUND OF THE INVENTION

Technical Field

This invention relates generally to a lower receiver for an AR type rifle and more particularly to a right hand or left hand configurable lower receiver for an AR type rifle.

State of the Art

Lower receivers for AR type rifles and firearms are formed for either a right hand shooter or a left hand shooter. The reasons for having one lower receiver for a right hand shooter and another lower receiver for a left hand shooter is the static ejector and the magazine button. The static ejector must eject a certain direction away from the shooter and the magazine button must be on a certain side depending on what hand the shooter is using to operate the trigger.

The market does not have a lower receiver that can be configured for either a right hand shooter or a left hand shooter. Accordingly, there is a need for such an improved lower receiver.

DISCLOSURE OF THE INVENTION

The present invention relates to a lower receiver for an AR type firearm that can be configured as a right hand or a left hand lower receiver.

Embodiments of the lower receiver include a static ejector that can be easily configured for right hand or left hand positions within the same lower receiver and a magazine button assembly having a left magazine button and a right magazine button that are operatively coupled together so that either magazine button can be pushed to release the magazine. This allows the gun builder to use this one lower to build a right or left handed rifle. In some embodiments, this lower receiver is mostly applicable to pistol caliber AR style rifles because the shorter length magazine (front to back), which allows for extra room to accommodate embodiments of this invention.

An embodiment includes a lower receiver comprising: a receiver body having a first static ejector channel left of a center line of the receiver body and a second static ejector channel right of the center line of the receiver body, the first and second static ejector channels formed in a top surface of the receiver body; a static ejector releasably coupled in the first static ejector channel or the second static ejector channel of the receiver body, wherein the static ejector ejects spent shells to a right of the receiver body when the static ejector is coupled in the first static ejector channel and ejects spent shells to a left of the receiver body when the static ejector is coupled in the second static ejector channel; and a magazine button assembly comprising: a right magazine button; and a left magazine button, wherein depressing the right magazine button or the left magazine button releases a magazine coupled to the lower receiver.

Another embodiment includes a lower receiver comprising: a receiver body having a first static ejector channel left of a center line of the receiver body and a second static ejector channel right of the center line of the receiver body, the first and second static ejector channels formed in a top surface of the receiver body; and a static ejector releasably coupled in the first static ejector channel or the second static ejector channel of the receiver body, wherein the static ejector ejects spent shells to a right of the receiver body when the static ejector is coupled in the first static ejector channel and ejects spent shells to a left of the receiver body when the static ejector is coupled in the second static ejector channel.

Yet another embodiment includes a lower receiver comprising: a magazine button assembly comprising: a right magazine button; and a left magazine button, wherein depressing the right magazine button or the left magazine button releases a magazine coupled to the lower receiver.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a lower receiver for an AR type firearm that can be configured as a right hand or a left hand lower receiver.

Figure 10:
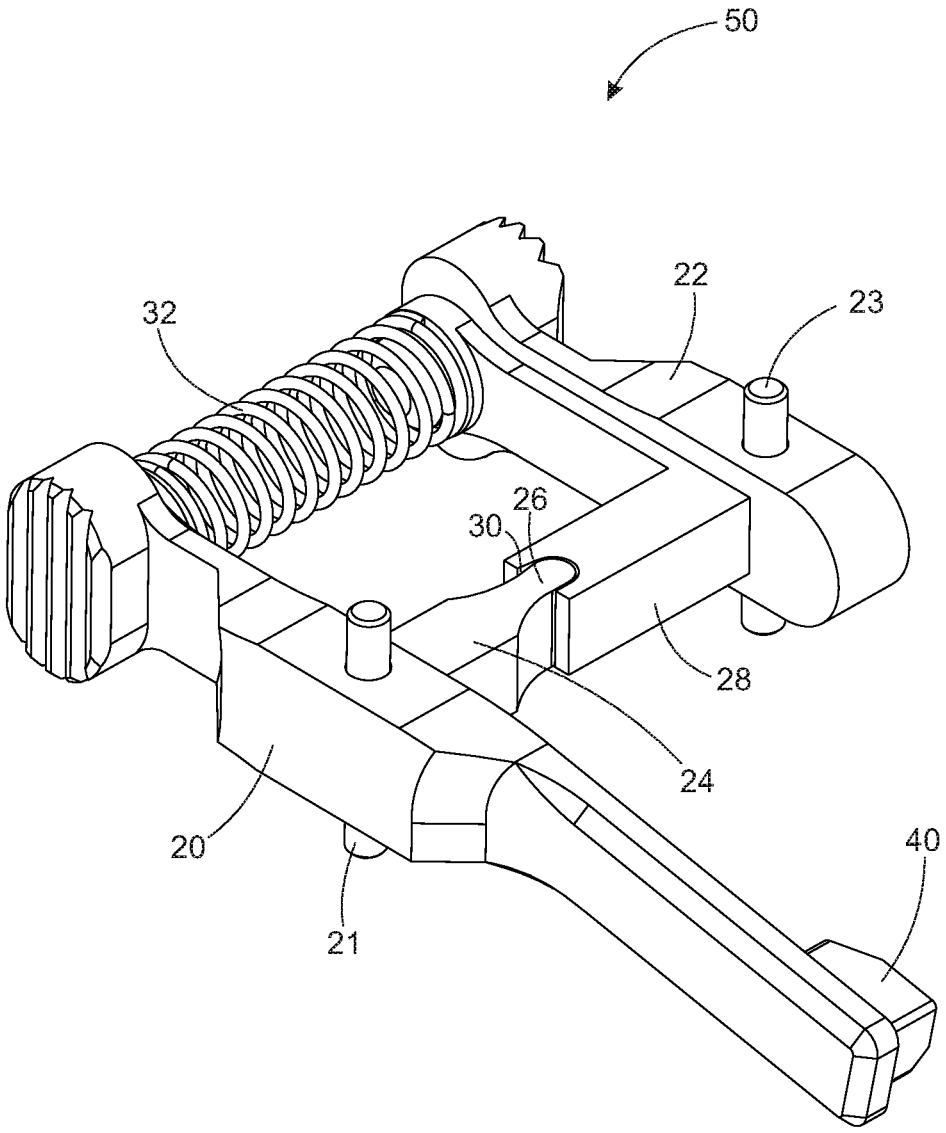
FIG. 10 is a first perspective view of a magazine button assembly in accordance with embodiments.
Figure 11:
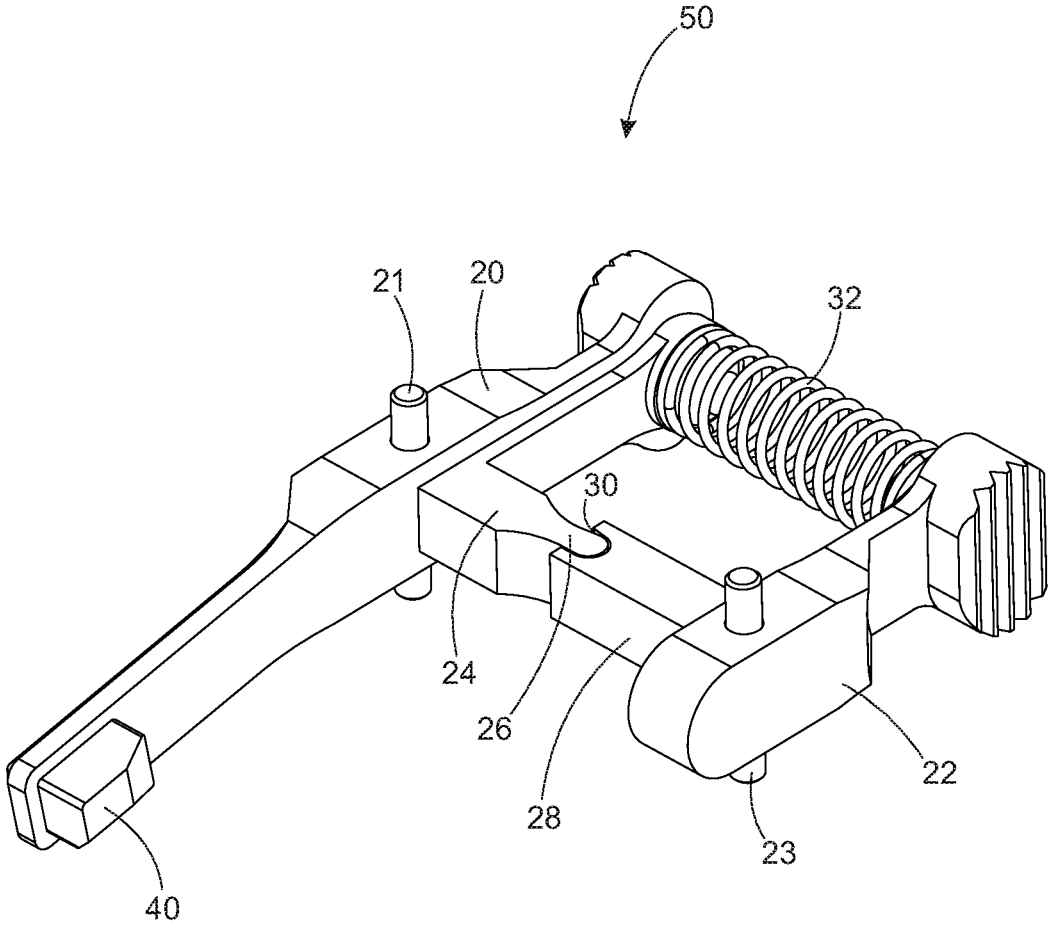
FIG. 11 is a second perspective view of a magazine button assembly in accordance with embodiments.

Referring to the drawings, FIGS. 1-5 depict an embodiment of a lower receiver 10. The lower receiver 10 includes a receiver body 12, a static ejector 14, a first static ejector channel 16 a second static ejector channel 17, ejector couplers 18 and a magazine button assembly 50 (See FIGS. 9-11).

Static Ejector

The static ejector 14 is what impacts a cartridge shell once the bolt has pulled out the spent cartridge shell from the barrel chamber and causes it to exit the rifle. On a right-handed rifle, the shell is ejected out the right side of the gun which necessitates that the ejector be left of center of the barrel and bolt. The static ejector 14 includes a front protrusion 11 operating to engage a spent cartridge shell when the bolt has pulled the spent cartridge from the barrel chamber. Further, the static ejector 14 includes an aperture 13 extending through the static ejector 14 and an extension member 15, wherein the aperture 13 and the extension member 15 are utilized to couple the static ejector within the first static ejector channel 16 or the second static ejector channel 17.

Figure 1:
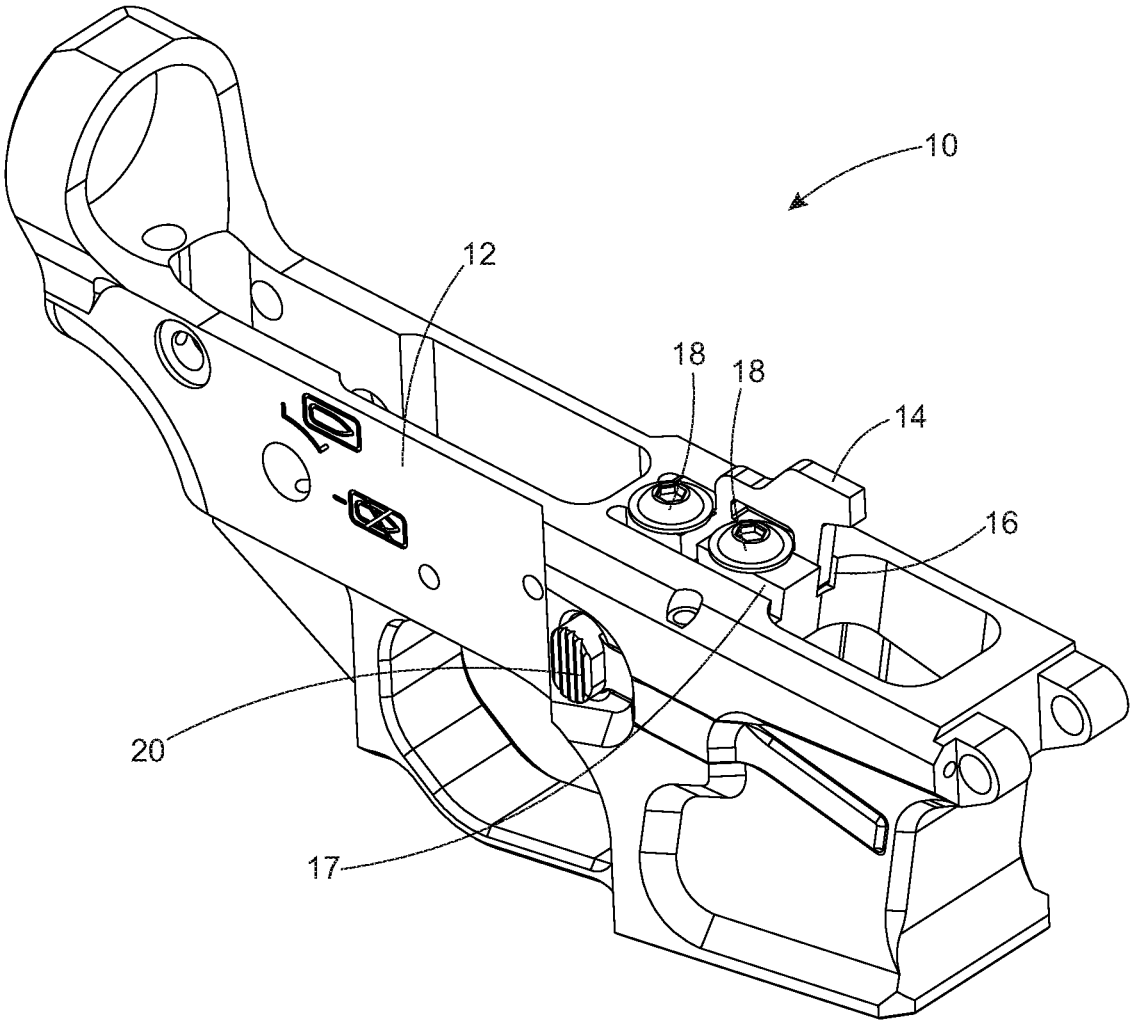
FIG. 1 is a front, right perspective view of a lower receiver in accordance with embodiments.
Figure 2:
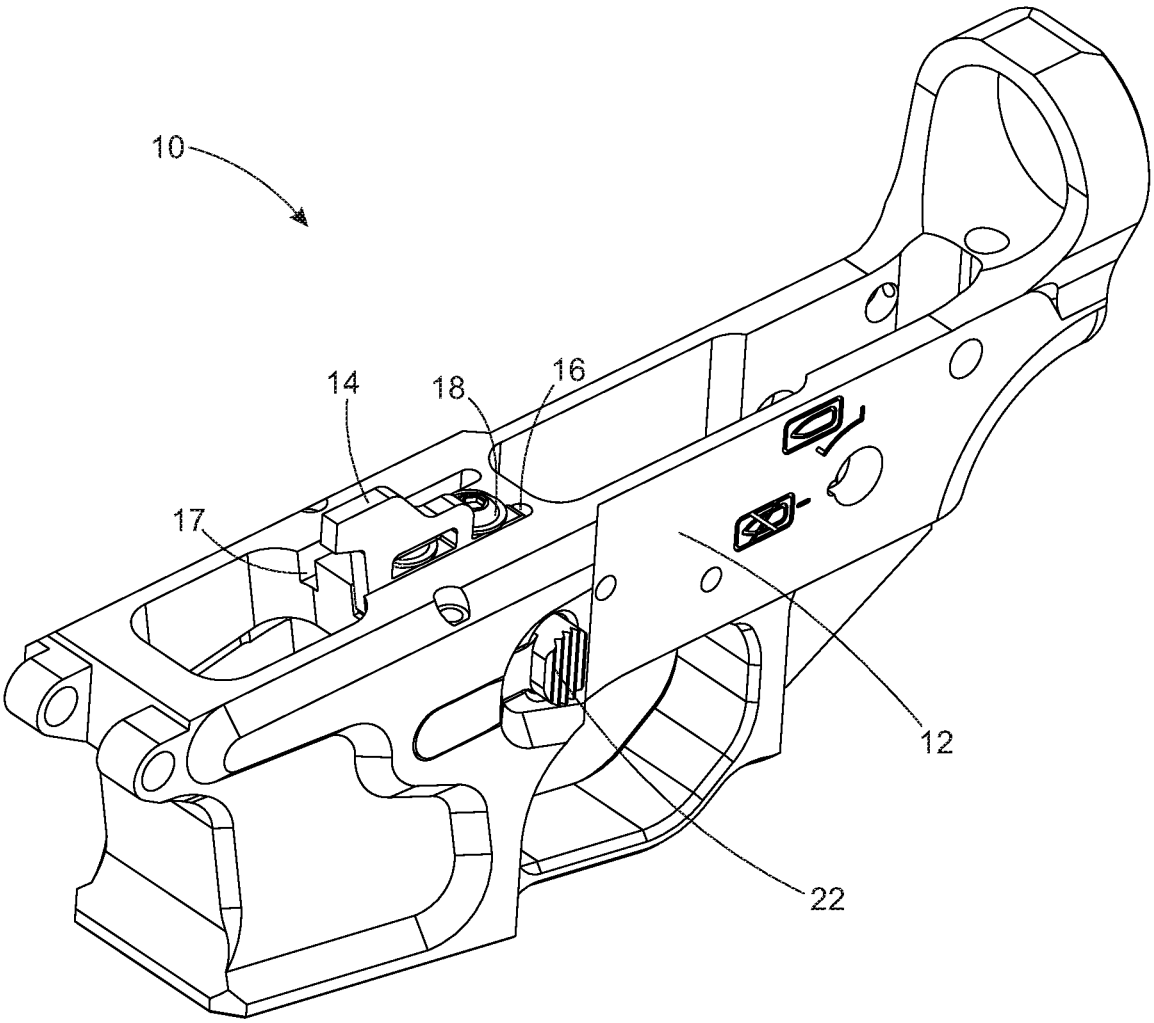
FIG. 2 is a front, left perspective view of a lower receiver in accordance with embodiments.
Figure 3:
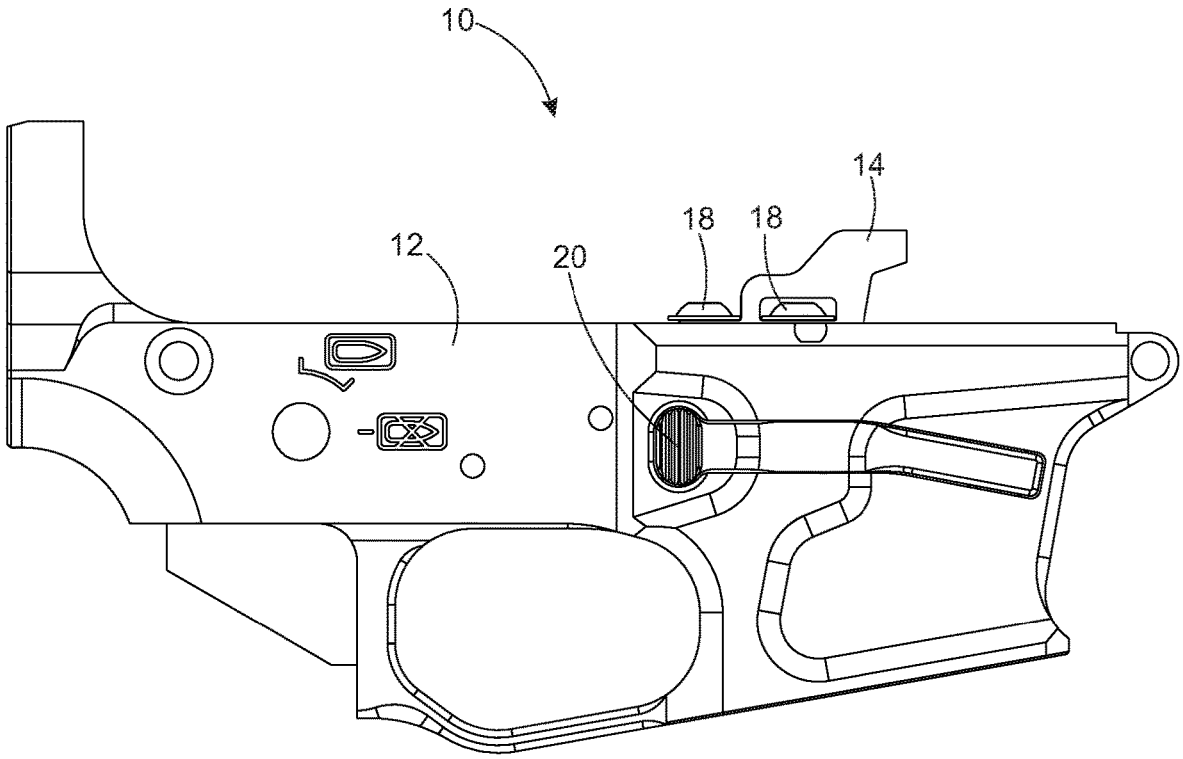
FIG. 3 is a right side view of a lower receiver in accordance with embodiments.
Figure 4:
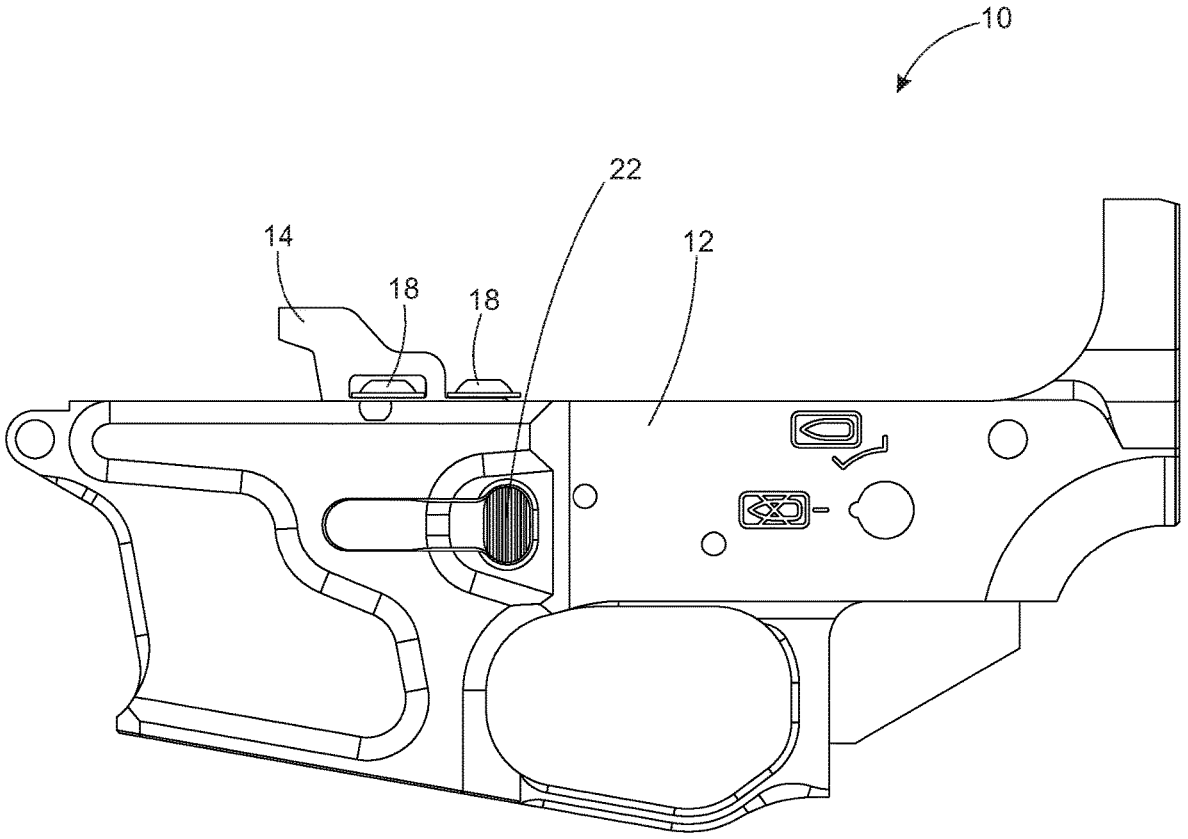
FIG. 4 is a left side view of a lower receiver in accordance with embodiments.
Figure 5:
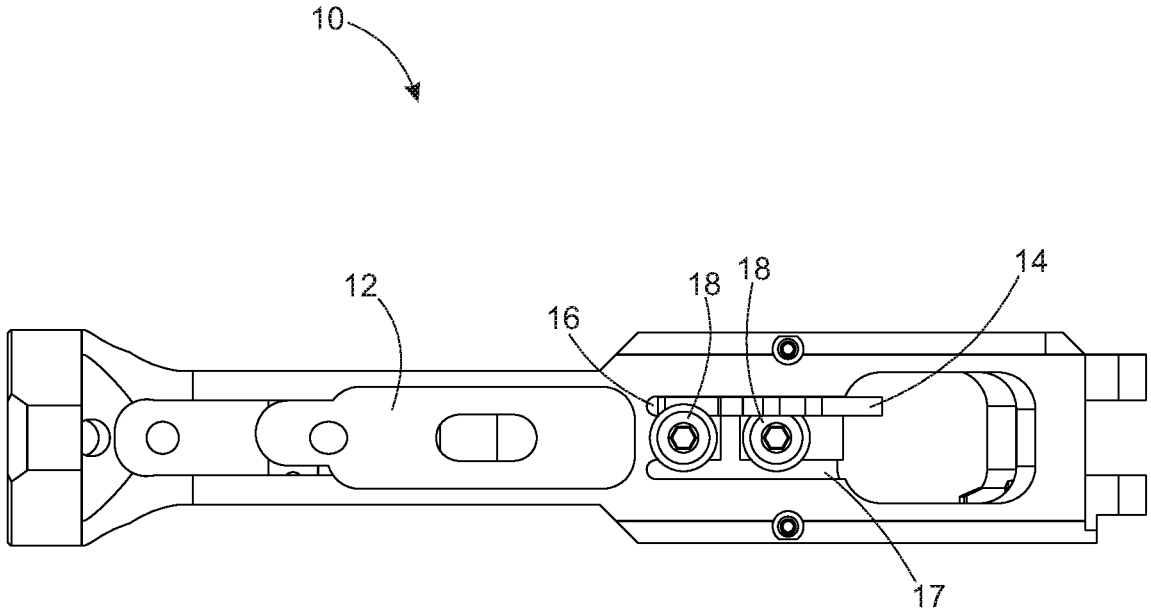
FIG. 5 is a top view of a lower receiver with a static ejector in a first position in accordance with embodiments.
Figure 6:
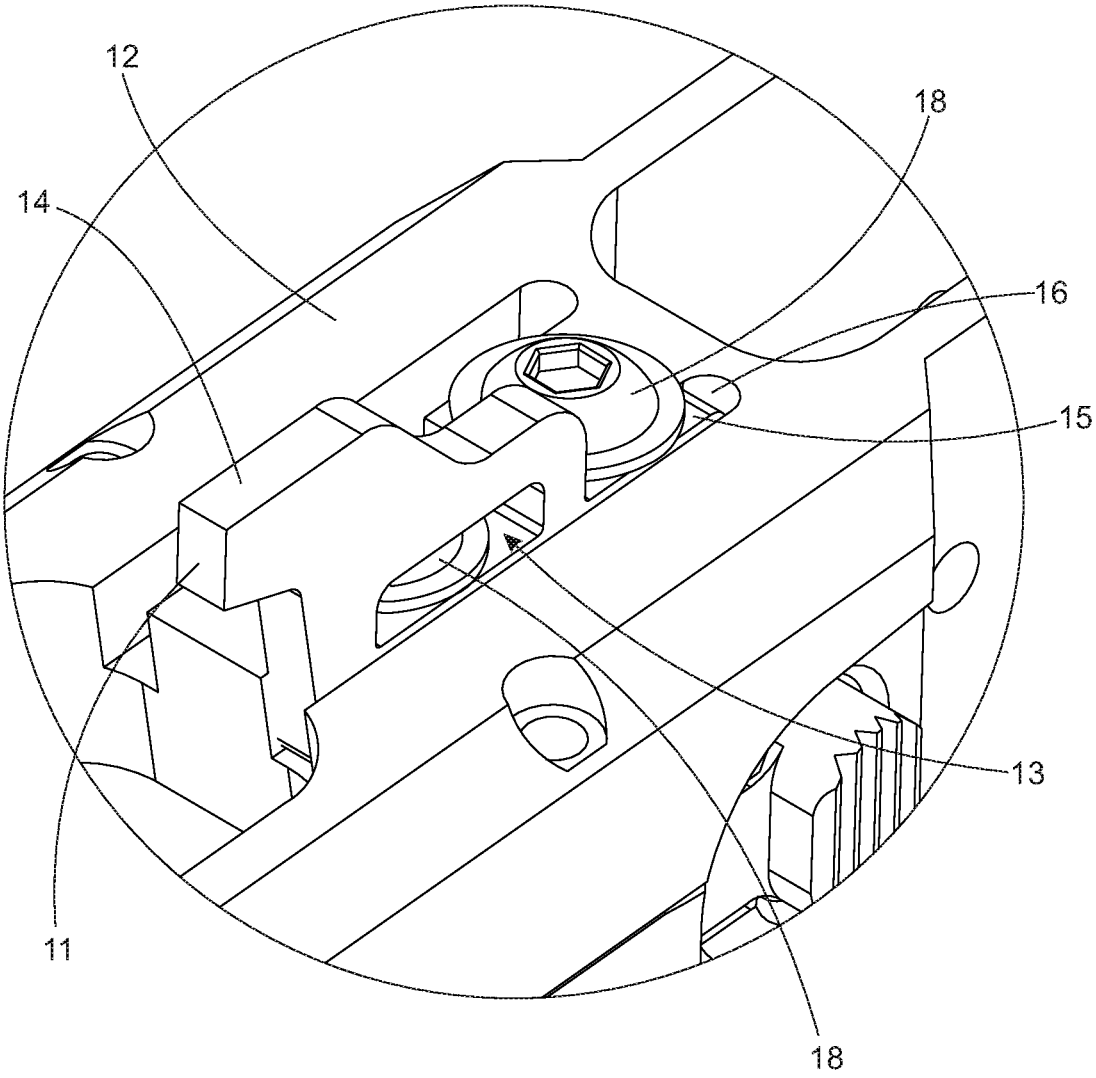
FIG. 6 is a close-up perspective view of a lower receiver with a static ejector in a first position in accordance with embodiments.
Figure 12:
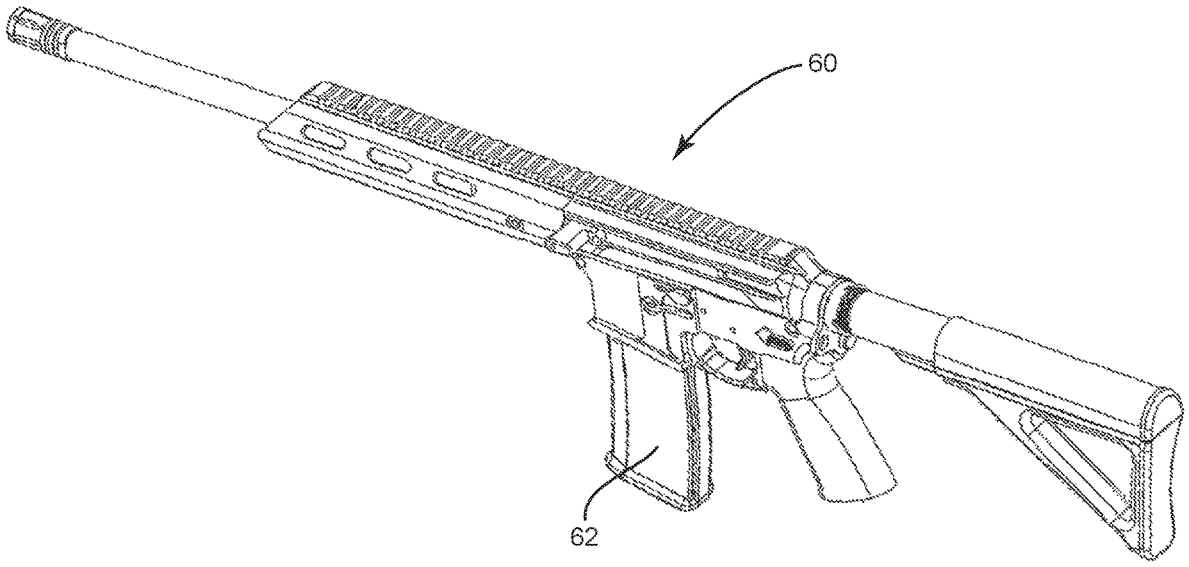
FIG. 12 is a perspective view of a rifle in accordance with embodiments.

As shown in FIGS. 5-6, the static ejector 14 is coupled within first static ejector channel 16 by use of the ejector couplers 18, wherein the ejector couplers 18 may couple directly to the receiver body 12 and directly engage the static ejector 14. The ejector couplers 18 may be threaded bolts that engage threaded recesses located between the first static ejector channel 16 and the second static ejector channel 17 in order to removably coupled to the receiver body 12. The ejector coupler 18 may further include a lip that engages the ejector coupler, wherein one ejector coupler 18 engages static ejector 14 within the aperture 13 and the other ejector coupler 18 engages the extension member 15 of the static ejector, thereby coupling the static ejector 14 within the first static ejector channel 16. First channel 16 is located left of center of the barrel and bolt when the lower receiver 10 is operatively coupled to an upper receiver and the remaining components of a firearm, such as, but not limited to an AR type rifle 60 as depicted in FIG. 12. On a left-handed rifle, the shell is ejected out the left side of the gun which necessitates that the ejector be right of center of the barrel and bolt.

Figure 7:
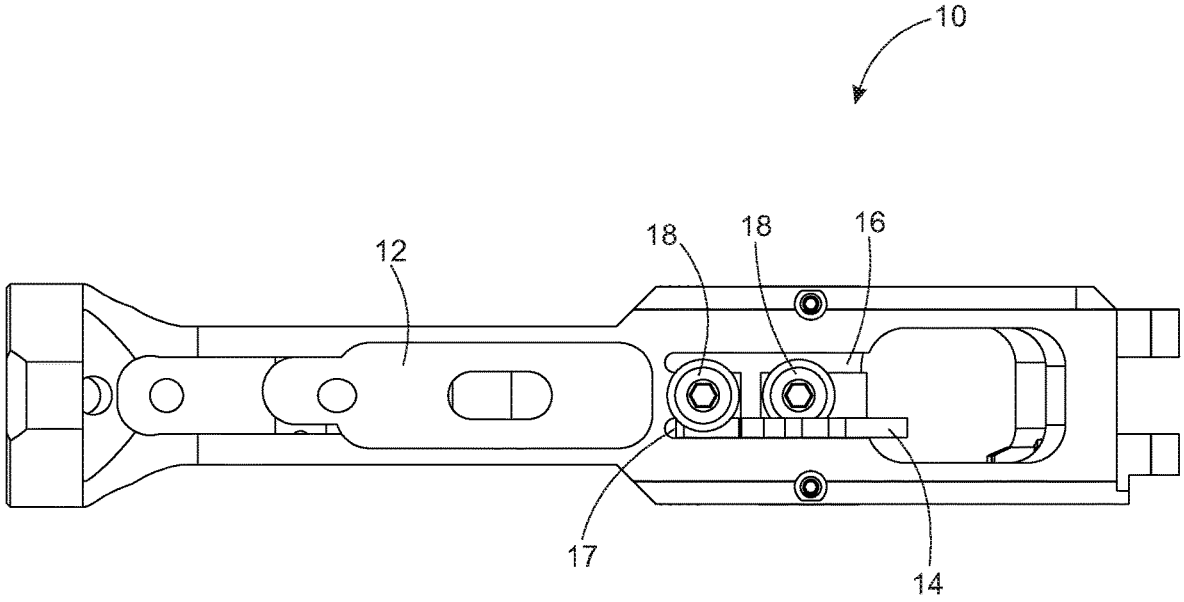
FIG. 7 is a top view of a lower receiver with a static ejector in a second position in accordance with embodiments.
Figure 8:
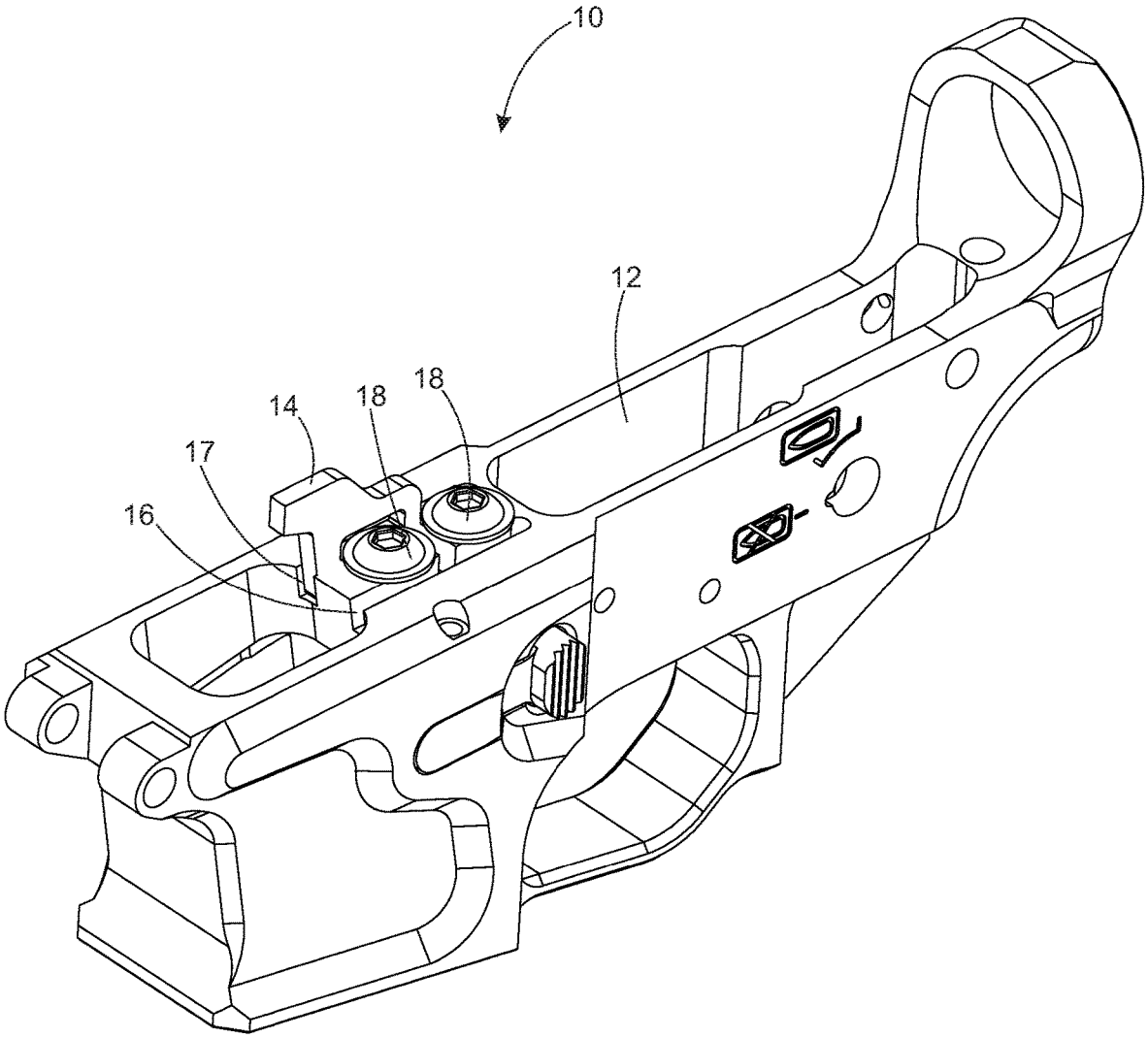
FIG. 8 is a close-up perspective view of a lower receiver with a static ejector in a second position in accordance with embodiments.

As shown in FIGS. 7-8, the static ejector 14 is coupled within channel 17 by use of the ejector coupler 18, wherein the ejector couplers 18 may couple directly to the receiver body 12 and directly engage the static ejector 14. The ejector couplers 18 may be threaded bolts that engage threaded recesses located between the first static ejector channel 16 and the second static ejector channel 17 in order to removably coupled to the receiver body 12. The ejector coupler 18 may further include a lip that engages the ejector coupler, wherein one ejector coupler 18 engages static ejector 14 within the aperture 13 and the other ejector coupler 18 engages the extension member 15 of the static ejector, thereby coupling the static ejector 14 within the second static ejector channel 17. Second channel 17 is located right of center of the barrel and bolt when the lower receiver is operatively coupled to an upper receiver and the remaining components of a firearm, such as, but not limited to an AR type rifle.

In other words, as shown in FIGS. 5-8, the receiver body 12 includes two slots or channels 16 and 17 formed in a top surface of the receiver body 12, which locates the static ejector 14 in a right or left hand position. There are two threaded holes and fasteners or couplers 18 centered between the first and second channels 16 and 17 that are used to engage two surfaces of the static ejector 14 to secure the static ejector 14 in either the first channel 16 or the second channel 17.

Magazine Release Assembly

Referring to FIGS. 1-5 and 9-11, to allow a right or left handed shooter to use the same lower receiver 10, it requires a magazine assembly 50 having a right magazine release button 20 and a left magazine release button 22 on right and left sides of the lower receiver body 12 respectively working together.

Figure 9:
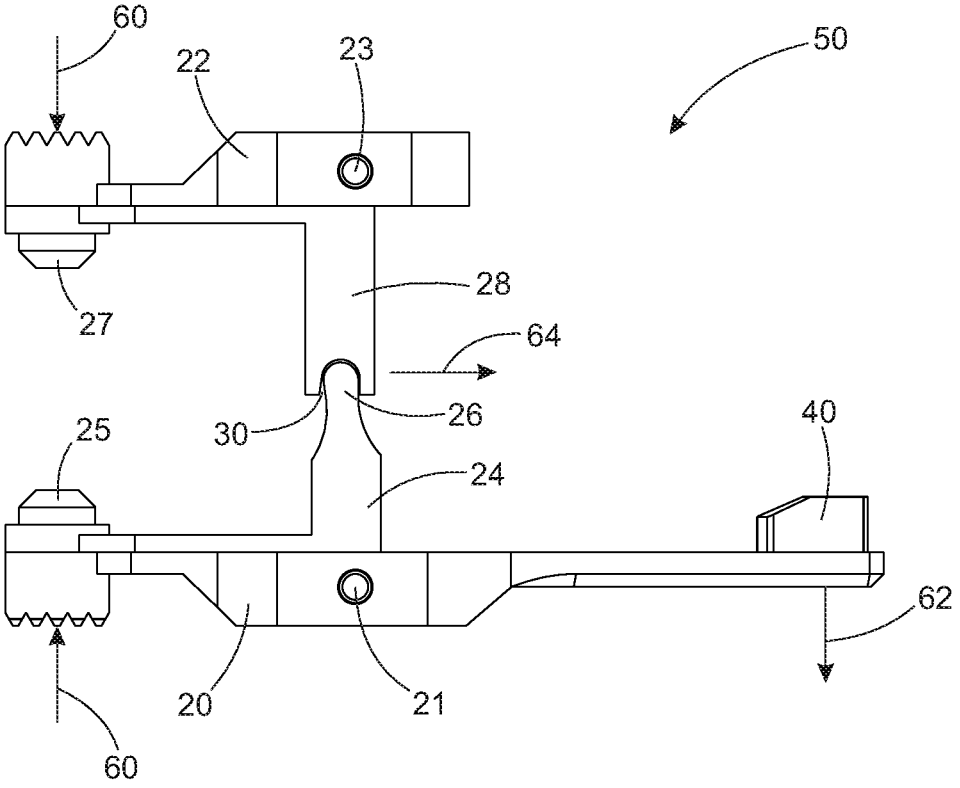
FIG. 9 is a top view of a magazine button assembly in accordance with embodiments.

The magazine buttons 20 and 22 are coupled between their pivot pins 21 and 23 respectively so that the movement of one will cause movement in the other. The drawings show a right magazine button 20 with a pivot pin 21 and a protrusion 24 extending from a location of the pivot pin 21 with a first hinge joint member 26, and show a left magazine button 22 with a pivot pin 23 and a protrusion 28 extending from a location of the pivot pin 23 with a second hinge joint member 30. The first hinge joint member 26 engages second hinge joint member 30 in a pin and slot arrangement wherein the first hinge joint member 26 may be a pin and the second hinge joint member 30 may be a slot. However, it will be understood that other hinge joint members may be used, such as, but not limited to gear teeth, sprocket teeth, and the like. This hinge joint allows ether button 20 or 22 to be pushed and depress the other one simultaneously. As shown in FIG. 9, as a user depresses right magazine button 20 or the left magazine button 22 in the direction of arrows 60, the other magazine button is depressed in response to the first hinge joint member 26 and the second hinge joint member 30 operating to translate the rotation of the first magazine button 20 in one direction to rotation of the second magazine button 22 in the opposite direction, in response to the first and second hinge joint members 26 and 30 moving in direction 64. Depressing either the first or second magazine button 20 or 22 moves a magazine engagement member 40 away from the receiver body in direction 62, to disengage the magazine engagement member 40 from a magazine catch (not shown) coupled to the receiver body 12.

One of the sides engages the magazine catch with a magazine engagement member 40, as depicted as part of the right magazine button 20. The drawings show an arrangement where the magazine catch would be on the right side. Magazines can have a catch on either side so the system can be mirrored to accommodate a catch on the left of the magazine. The buttons 20 and 22 on the lower receiver body 12 are also placed in the same position as standard AR type rifles.

Opposite a button surface on a button end of each magazine button is a boss 25 or 27 that operate to locate one side of the return spring 32. In other words, one end of the spring is pushing on the left boss 27 button and the other on the right boss 25. This spring 32 keeps the magazine 62 (see FIG. 12) secured and in position when the buttons 20 and 22 are not pushed.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A lower receiver comprising:

a receiver body having a first static ejector channel left of a center line of the receiver body and a second static ejector channel right of the center line of the receiver body, the first and second static ejector channels formed in a top surface of the receiver body;

a static ejector releasably coupled in the first static ejector channel or the second static ejector channel of the receiver body, wherein the static ejector ejects spent shells to a right of the receiver body when the static ejector is coupled in the first static ejector channel and ejects spent shells to a left of the receiver body when the static ejector is coupled in the second static ejector channel; and a magazine button assembly comprising:

a right magazine button; and a left magazine button, wherein depressing the right magazine button or the left magazine button releases a magazine coupled to the lower receiver.

2. The lower receiver of claim 1, wherein the static ejector is coupled to the first static ejector channel or the second static ejector channel with two ejector couplers.

3. The lower receiver of claim 2, wherein the static ejector comprises an aperture and an extension member.

4. The lower receiver of claim 3, wherein a lip of one of the ejector coupler engages the static ejector within the aperture and a lip the other ejector coupler engages the extension member in response to the ejector couplers removably coupled to the receiver body.

5. The lower receiver of claim 1, wherein the right magazine button includes a pivot point and a protrusion extending from a location of the pivot point, the protrusion having a first hinge joint member, wherein the right magazine button includes a magazine engagement member.

6. The lower receiver of claim 5, wherein the left magazine button includes a pivot point and a protrusion extending from a location of the pivot point, the protrusion having a second hinge joint member.

7. The lower receiver of claim 6, further comprising a spring coupled between button ends of the right magazine button and the left magazine button, wherein the right magazine button and the left magazine button may be operatively coupled together with the first hinge joint member engaging the second hinge joint member to locate a hinge joint between the pivot points, and wherein pressing of the button end of the right magazine button or the left magazine button rotates the magazine engagement member away from a magazine to disengage the magazine engagement member.

8. The lower receiver of claim 1, wherein the lower receiver is coupled to a rifle.

* * * * *